US012384978B1

(12) United States Patent
Molintas

(10) Patent No.: US 12,384,978 B1
(45) Date of Patent: Aug. 12, 2025

(54) APPARATUS AND METHOD FOR CAPTURING RENEWABLE AND NON-RENEWABLE ENERGY FROM BIODEGRADABLE AND NON-BIODEGRADABLE MUNICIPAL WASTE

(71) Applicant: United States of America as Represented by the Secretary of the Navy, Arlington, VA (US)

(72) Inventor: Henry Molintas, Olney, MD (US)

( * ) Notice: Subject to any disclaimer, the term of this patent is extended or adjusted under 35 U.S.C. 154(b) by 0 days.

(21) Appl. No.: 18/406,373

(22) Filed: Jan. 8, 2024

Related U.S. Application Data

(62) Division of application No. 18/058,466, filed on Nov. 23, 2022, now Pat. No. 11,905,476.

(60) Provisional application No. 63/283,833, filed on Nov. 29, 2021.

(51) Int. Cl.
*C10J 3/00* (2006.01)
*C10J 3/84* (2006.01)

(52) U.S. Cl.
CPC ..... *C10J 3/007* (2013.01); *C10J 3/84* (2013.01); *C10J 2200/09* (2013.01); *C10J 2200/158* (2013.01); *C10J 2300/0906* (2013.01); *C10J 2300/0946* (2013.01); *C10J 2300/0976* (2013.01); *C10J 2300/1823* (2013.01)

(58) Field of Classification Search
CPC ..... C10J 3/721; C10J 3/723; C10J 3/66; C10J 2300/1207; C10J 2300/0946
See application file for complete search history.

(56) References Cited

U.S. PATENT DOCUMENTS 5,423,891 A * 6/1995 Taylor ..... C10J 3/12 48/209
5,443,772 A * 8/1995 Inoue ..... B29B 17/02 264/102
5,851,246 A * 12/1998 Bishop ..... C10J 3/14 422/209
6,149,773 A * 11/2000 Grimshaw ..... F23G 5/0273 201/31
9,458,073 B2 10/2016 Lucas
11,795,407 B2 10/2023 Niu
(Continued)

OTHER PUBLICATIONS

Henry Molintas and Ashwani Gupta, "Non-Isothermal Pyrolysis Kinetics of Municipal Solid Wastes," 9th Annual International Energy Conversion Engineering Conference Jul. 31-Aug. 3, 2011, San Diego, California (pp. 2-5).
(Continued)

*Primary Examiner* — Imran Akram
(74) *Attorney, Agent, or Firm* — Jesus J. Hernandez; U.S. Department of the Navy, Office of the General Counsel

(57) ABSTRACT

Exemplary embodiments provide a pyro gasifyer apparatus and method that may be used in a pyro-gasification system. According to an example embodiment, a loading unit may receive waste and a pyro gasifier unit may receive the waste and convert it into purified syngas through a two-stage process using exhaust gas and a gasifying agent. An engine may receive the purified syngas and generate the exhaust gas, such that a gasifying unit may generate the gasifying agent using energy provided by the exhaust gas. A control unit may monitor and control the amount of the purified syngas, the exhaust gas, and the gasifying agent.

9 Claims, 5 Drawing Sheets

(56) References Cited

U.S. PATENT DOCUMENTS

2002/0095866 A1* 7/2002 Hassett ..... C10J 3/34 422/150
2002/0159929 A1* 10/2002 Kaneko ..... C10J 3/84 48/199 FM
2004/0052724 A1* 3/2004 Sorace ..... C01B 3/22 48/89
2005/0095183 A1* 5/2005 Rehmat ..... C10K 3/006 422/600
2005/0247553 A1* 11/2005 Ichikawa ..... C10K 3/006 202/96
2007/0049648 A1* 3/2007 Shessel ..... C01B 13/0248 60/772
2007/0094929 A1* 5/2007 Kang ..... C10K 1/18 48/197 FM
2007/0245934 A1* 10/2007 Carman ..... F23G 7/10 110/267
2007/0294937 A1* 12/2007 Stein ..... F23G 5/0273 44/605
2008/0209807 A1* 9/2008 Tsangaris ..... C10J 3/82 48/89
2008/0222956 A1* 9/2008 Tsangaris ..... C10J 3/18 48/77
2009/0218424 A1* 9/2009 Hauserman ..... B02C 13/286 241/29
2010/0101141 A1* 4/2010 Shulenberger ..... C10L 5/363 422/600
2010/0276270 A1* 11/2010 Jeswine ..... C10B 53/00 202/99
2011/0114144 A1 5/2011 Green et al.
2011/0212012 A1 9/2011 McAlister
2012/0304540 A1* 12/2012 Hulteberg ..... C10K 1/046 48/128
2012/0310023 A1 12/2012 Huang et al.
2013/0000569 A1 1/2013 Schneider
2013/0300121 A1* 11/2013 Ali ..... F23J 15/02 110/221
2016/0115063 A1 4/2016 Ronsch et al.
2016/0222587 A1 8/2016 Fatehi et al.
2017/0218284 A1* 8/2017 Liss ..... C10J 3/005
2018/0051877 A1* 2/2018 Liss ..... F23G 5/12
2018/0119019 A1* 5/2018 Stanley ..... C10J 3/007
2020/0340669 A1* 10/2020 Lucas ..... F23G 5/12
2021/0162339 A1 6/2021 Sekhar

OTHER PUBLICATIONS

Ewa Sygula, , Kkacper Swiechowski, Malgorzata Hejna, Ines Kunaszyk, Andrzej Bialowiec, "Municipal Solid Waste Thermal Analysis—Pyolysis Kinetics and Decomposition Reactions," Energies 2021, issue 14, 4510 (pp. 23-24).

* cited by examiner

APPARATUS AND METHOD FOR CAPTURING RENEWABLE AND NON-RENEWABLE ENERGY FROM BIODEGRADABLE AND NON-BIODEGRADABLE MUNICIPAL WASTE

CROSS-REFERENCE TO RELATED APPLICATIONS

This application claims the benefit of and is a Divisional Application of U.S. patent application Ser. No. 18/058,466, filed Nov. 23, 2022, which claims priority under 35 U.S.C. § 119 (e) to U.S. Provisional Application No. 63/283,833 filed Nov. 29, 2021, both titled "Apparatus and Method for Capturing Renewable and Non-Renewable Energy from Biodegradable and Non-Biodegradable Municipal Waste," and the entire contents of which are incorporated herein by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a system for providing renewable and non-renewable energy from biodegradable and non-biodegradable municipal wastes.

BACKGROUND

Use of municipal solid waste as an energy source has captured the interest of energy researchers. Waste containing biodegradables and some plastics is considered a renewable energy source. Such waste has low ash and sulfur content. There are various approaches to processing such waste. One approach is pyro-gasification, which consists in heating waste to a high temperature to produce a gas. Co-firing biodegradable waste is a good approach to reduce fossil fuel depletion and air pollution. Most pyro-gasification systems are fixed reactors and have no moving parts.

An issue that arises in processing this sort of waste is with respect to the reduction, or particularization, of waste to desired dimensions. Depending on the type of processor, shredded biodegradable waste particles are much larger than other forms of pulverized particles, such as coal. For updraft or downdraft packed bed processors, some of the shredded waste used can be between 5 to 100 mm when received by a processing unit. There may also be some preprocessing of such waste to reduce the size further. With fluidized-bed gasifiers and combustors, waste is pelletized between 2 to 5 mm or sometimes larger depending on fluidization conditions. Waste may undergo additional processes. Particularization of waste can become more complex when waste particles are larger than 1 mm.

SUMMARY

Exemplary embodiments provide a pyro gasifyer apparatus and method that may be used in a pyro-gasification system.

According to an example embodiment, a loading unit may receive waste and a pyro gasifier unit may receive the waste and convert it into purified syngas through a two-stage process using exhaust gas and a gasifying agent. An engine may receive the purified syngas and generate the exhaust gas, such that a gasifying unit may generate the gasifying agent using energy provided by the exhaust gas. A control unit may monitor and control the amount of the purified syngas, the exhaust gas, and the gasifying agent.

BRIEF DESCRIPTION OF DRAWINGS

The accompanying figures are included to provide a further understanding of example embodiments, and are incorporated in and constitute part of this specification. In the figures.

DETAILED DESCRIPTION

In the following description, for purposes of explanation and not limitation, specific details are set forth such as particular structures, designs, techniques, etc., in order to provide a thorough understanding of the example embodiments. However, it will be apparent to those skilled in the art that the disclosed subject matter may be practiced in other illustrative embodiments that depart from these specific details. In some instances, detailed descriptions of well-known elements and/or method are omitted so as not to obscure the description with unnecessary detail. All principles, aspects, and embodiments, as well as specific examples thereof, are intended to encompass both structural and functional equivalents of the disclosed subject matter. Additionally, it is intended that such equivalents include both currently known equivalents as well as equivalents developed in the future.

The following description refers to an apparatus and method for capturing renewable and non-renewable energy from biodegradable and non-biodegradable municipal waste. However, it should be noted that the example embodiments shown and described herein are meant to be illustrative only and not limiting in any way. As such, various modifications will be apparent to those skilled in the art for application to the capture of renewable and nonrenewable energy based on technologies other than the above, which may be in various stages of development and intended for future replacement of, or use with, the above described method or apparatus.

The goal of the invention is to provide renewable and non-renewable energies from biodegradable (e.g., paper, wood, yard trimmings and food) and non-biodegradable (e.g., mostly plastic and waste oil) municipal wastes, respectively. The device and method uses an intelligently controlled two-stage pyro-gasifier incorporating swirls, catalysts, and mixtures of novel gasifying agents, followed by a gas purifying system. Machine learning may be incorporated to maximize energy capture efficiency via system control optimization. The first stage generates raw synthesis gases (syngas) after waste drying, pyrolysis and gasification. The raw syngas may include, but is not limited to: carbon monoxide (CO), carbon dioxide ($CO_2$) traces, char particulates, hydrogen ($H_2$), as well as light and heavy carbon-hydrogen compounds ($C_nH_m$) like tars, methane ($CH_4$), acetylene ($C_2H_2$), and other char particulates. The second stage refines the raw syngas from the first stage by reducing tars, particulates, and acid gases from the raw syngas.

Figure 1:
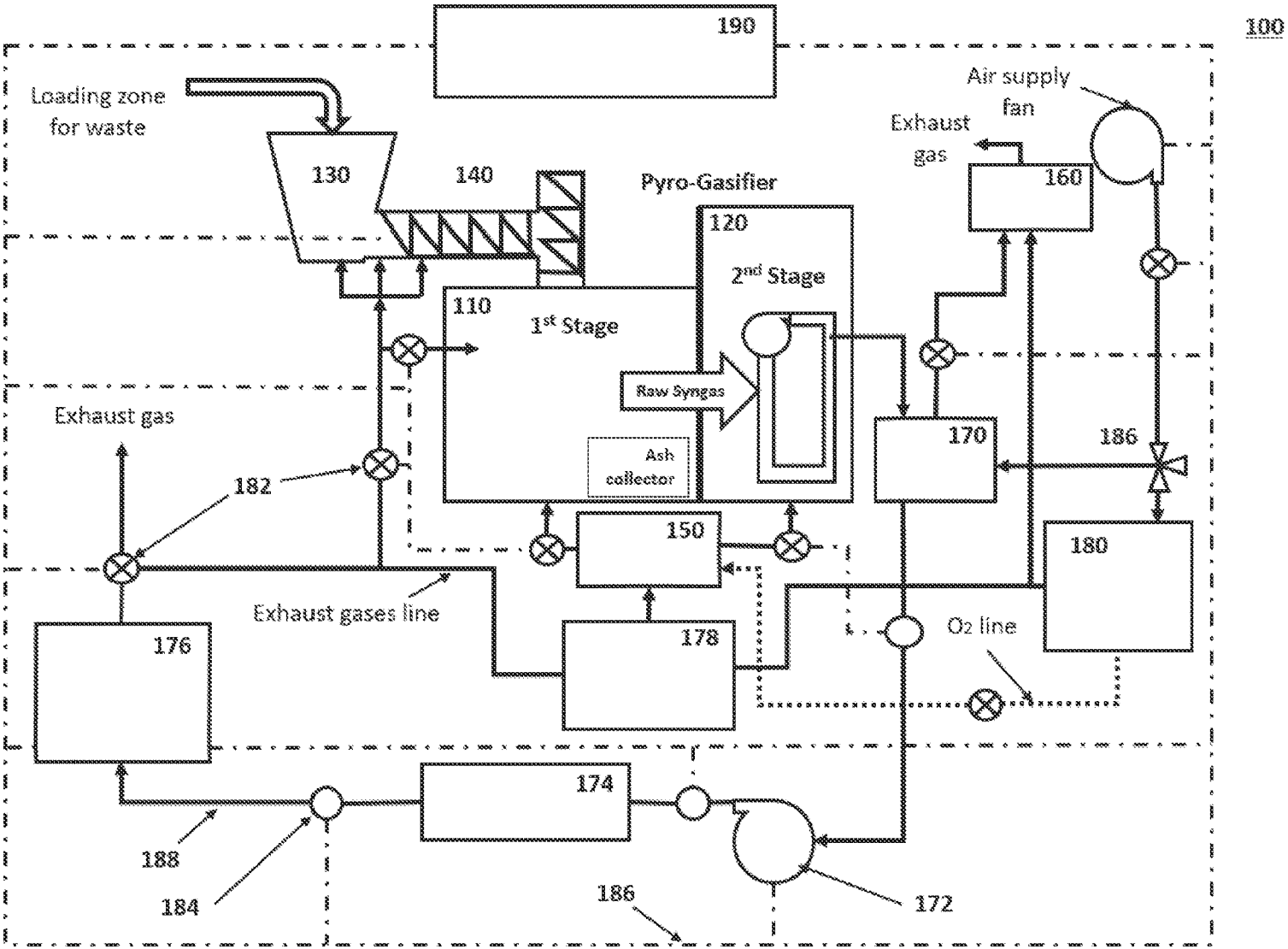
FIG. 1 is the schematic diagram of an exemplary pyro-gasification system for municipal solid waste (MSW) to energy conversion, according to an embodiment of the invention.

FIG. 1 is the schematic diagram of an exemplary pyro-gasification system 100 for municipal solid waste (MSW) to energy conversion, according to an embodiment of the invention. According to FIG. 1, the pyro-gasification system 100 receives waste through a loading zone. The waste then travels through a waste shredder 130. The waste may be biodegradable (e.g., paper, wood, yard trimmings and food) and non-biodegradable (e.g., mostly plastic and pipe fed waste oil) municipal wastes. The waste proceeds to a rotating screw feeder 140. From this point, the waste enters a two-stage pyro-gasifier. The first stage 110 of the pyro-gasifier particularizes and dries the shredded waste. The first stage 110 may also include an ash collector to collect metals and other materials. The first stage 110 of the pyro-gasifier may also receive gasifying agents. The gasifying agents may include hydrogen peroxide ($H_2O_2$), oxygen ($O_2$), vitiated air, and/or products of the gas engine or turbine generator 176. In some embodiments, the first stage 110 may also undertake first stage pyrolysis. The pyro gasifier produces raw syngas that is forwarded to the second stage 120 of the pyro-gasifier.

The second stage 120 of the pyro-gasifier includes a swirler system. The swirler system may include a syngas compressor that provides energy to create a recirculating loop. The second stage 120 of the pyro-gasifier also receives gasifying agents. The gasifying agent may be received from a separate unit. For example, as illustrated in FIG. 1, the second stage 120 of the pyro-gasifier receives hydrogen peroxide ($H_2O_2$) from a $H_2O_2$ system 150. One or more flow valves 182 may control the amount of gasifying agent entering the second stage 120 of the pyro-gasifier. In some embodiments, the second stage 120 may also undertake second stage pyrolysis.

The second stage 120 of the pyro-gasifier produces purified syngas that is received by a syngas cooler 170. The syngas cooler 170 is an air-cooled (or water-cooled) non-contact heat exchanger. The syngas cooler 170 receives air from an air supply fan. The supplied air may be controlled by various valves, such as 3-way valve 186 and a valve 182. The syngas cooler 170 expels output to the air preheater 160. The air preheater 160 expels exhaust gas, which may be dispensed with or recycled as a renewable form of energy or heat within the pyro-gasification system 100. The syngas cooler 170 feeds the purified syngas to a syngas fan/compressor 172. The syngas fan/compressor 172 feeds the syngas accumulator 174, which collects the purified syngas.

Once the above described process takes place, a gas engine or turbine generator 176 may receive refined syngas 188 from the syngas accumulator 174. The amount received by the gas engine or turbine generator 176 may be controlled by a flow valve 184. The gas engine or turbine generator 176 is connected to at least one exhaust gas line. The exhaust gas from the gas engine or turbine generator 176 may be dispensed with or recycled as a renewable form of energy or heat within the pyro-gasification system 100. The exhaust gas may serve as a heated gasifying agent for use throughout the exemplary pyro-gasification system 100. As illustrated in FIG. 1, the exhaust gas lines from the gas engine or turbine generator 176 may be connected to the waste shredder 130, the rotating screw feeder 140, and the first stage 110 of the pyro-gasifier. Also, the exhaust gas lines emanating from the gas engine or turbine generator 176 may be connected to a steam generator and superheater 178. These exhaust gas lines may also be controlled by a flow valve 184. The steam generator and superheater 178 feeds the $H_2O_2$ system 150. The $H_2O_2$ system 150 may also receive input from an oxygen ($O_2$) generator 180. The $H_2O_2$ system may create hydrogen peroxide ($H_2O_2$) by combining steam from the steam generator and superheater 178 and oxygen from the $O_2$ generator 180.

The exemplary pyro-gasification system 100 also includes an overarching control system and data acquisition system 190 that connects to the various flow valves 184 and 182 through power & control circuit system line 186. The control system and data acquisition system 190 may also control the rotating screw feeder 140. The control system and data acquisition system 190 may permit automated operation of the pyro-gasification system 100.

The control system and data acquisition system 190 may include machine learning software that enhances system control optimization to maximize energy capture efficiency when processing wastes with wide variability in composition. For example, automated operation by the control system and data acquisition system 190 allows the pyro-gasification system 100 to operate the heating characteristics at the first stage 110 of the pyro-gasifier. This may be done via the use of exhaust gases from the gas engine or turbine generator 176. In the first stage 110 of the pyro-gasifier, the control system and data acquisition system 190 can ensure that the waste is dried further and pyrolyzed completely in a batch mode process. The first stage 110 may include load cells that measure the weight, moisture, gases, temperature, and other characteristics of the waste received and provide such information to the control system and data acquisition system 190. The load cells can also notify to the control system and data acquisition system 190 when drying or gasification is complete. In an embodiment, when the weight of the waste as measured by the load cells decreases and/or reaches a low steady state value, the heating system may be turned off automatically by the control system and data acquisition system 190. The control system and data acquisition system 190 may be, or work in conjunction with, a programmable logic controller (PLC). The control system and data acquisition system 190 may be programmed using machine learning to automatically adjust to sensed conditions without human input, or with limited human input.

Figure 2:
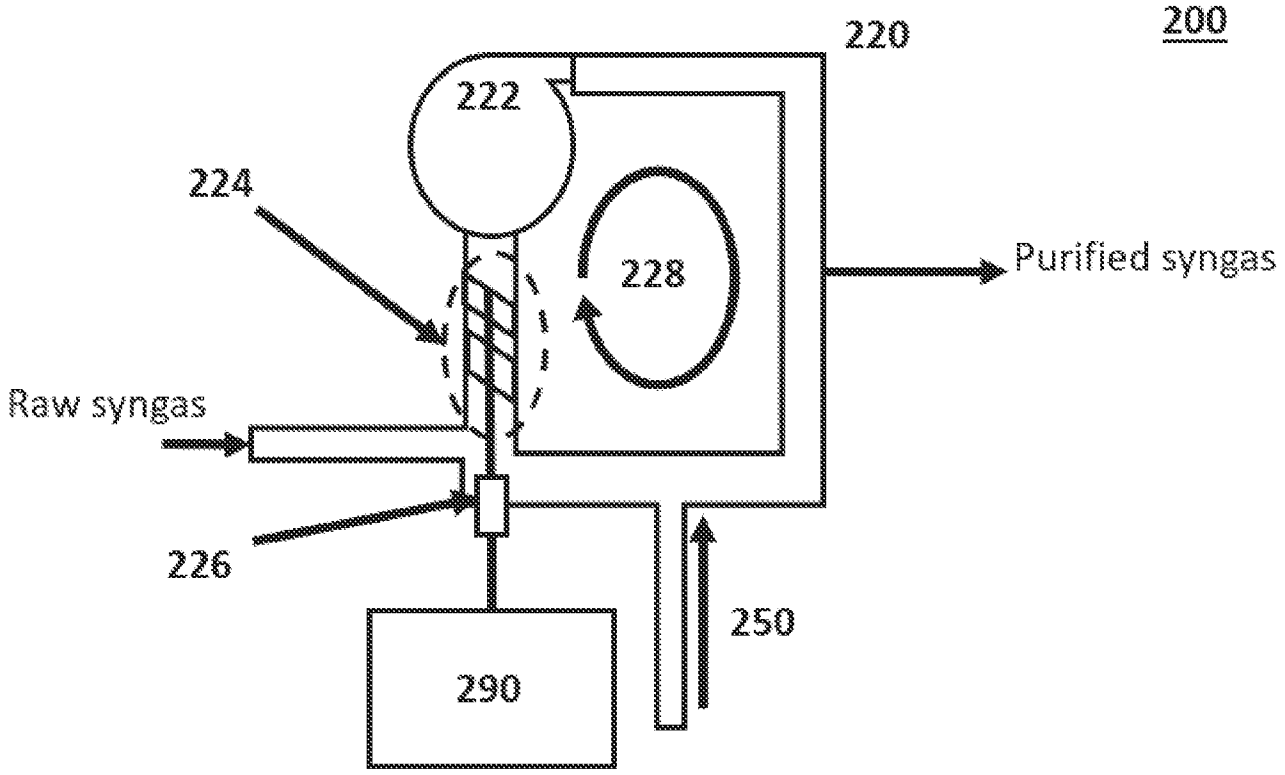
FIG. 2 is an exemplary second stage syngas purifier of a pyro-gasifier, according to an embodiment of the invention.

FIG. 2 is an exemplary second stage syngas purifier 200 of a pyro-gasifier, according to an embodiment of the invention. The syngas purifier 200 makes up the second stage 220 of a pyro-gasifier, which can be used as the second stage 120 of the pyro-gasifier in FIG. 1. As illustrated in FIG. 2, the syngas purifier 200 receives raw syngas from a first stage of a pyro-gasifier. The raw syngas traverses a swirler system, which encompasses a rotating screw 224, that may be powered by an electric motor 290. The syngas then traverses the entire syngas purifier 200 in a recirculating loop 228. A syngas compressor 222 may assist in recirculating the syngas in recirculating loop 228. Within this loop, gasifying agents 250 may be introduced. The gasifying agents 250 may be from a separate gasifying agent unit. The gasifying agent unit may be a hydrogen peroxide ($H_2O_2$) unit. The rotating screw 224 may be attached to a mechanical seal 226 to prevent the circulating syngas from escaping.

The gases may continue to be recirculated in recirculating loop 228 to ensure that the raw syngas is cleaned and refined. The swirling system acts as a gas purifying system by increasing residence time and enhancing mixing. The output of the syngas purifier 200 is purified syngas. The purified syngas may be extracted periodically and automatically conveyed into a syngas cooler with the assistance of the syngas compressor 222.

Figure 3:
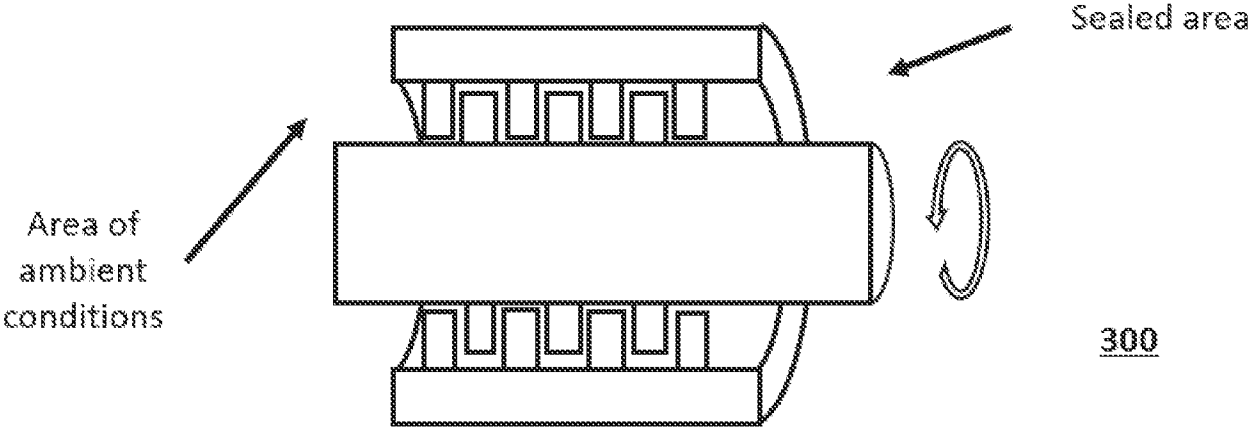
FIG. 3 is an exemplary labyrinth seal of a pyro-gasifier, according to an embodiment of the invention.

FIG. 3 is an exemplary labyrinth seal 300 of a pyro-gasifier, according to an embodiment of the invention. The labyrinth seal 300 is used by motors to rotate various operational screws (or swirler) in a sealed environment to prevent gases from escaping from the sealed area. The labyrinth seal 300 ensures that the gases used for the heating system do not directly come in contact with waste particles. As shown, the labyrinth seal 300 has a sealed area, where pyro-gasified wastes are located. The opposite side of the labyrinth seal 300 is in an area subject to ambient conditions. The labyrinth seal 300 maintains the pressure difference between environments. The labyrinth seal 300 is made of materials that can withstand high temperatures associated with the pyro-gasified wastes. For example, the labyrinth seal 300 may be made of metals, particularly heat-resistant metals. Conventional seals are made of rubber, but these are not practical in a pyro-gasification system. The labyrinth seal 300 may be used in the first stage of a pyro-gasifier. For example, the labyrinth seal 300 may be employed in the rotating screw feeder 140 in FIG. 1. In an embodiment, the labyrinth seal 300 may also be used in the second stage of a pyro-gasifier. For example, the labyrinth seal 300 may be employed with the rotating screw 224 in FIG. 2.

Figure 4:
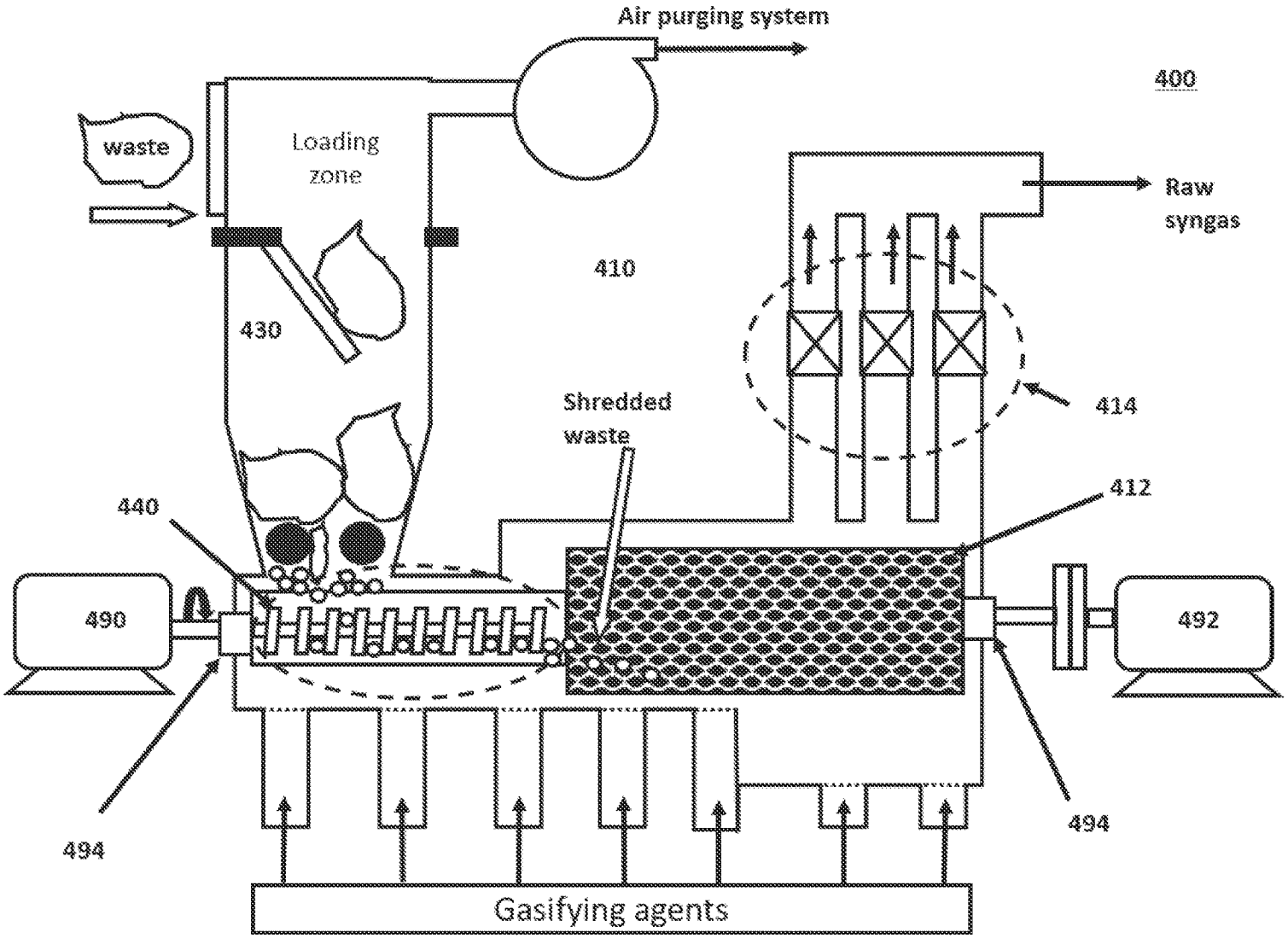
FIG. 4 is an exemplary horizontal first stage reactor design of a pyro-gasifier, according to an embodiment of the invention.

FIG. 4 is an exemplary horizontal first stage reactor design 400 of a pyro-gasifier, according to an embodiment of the invention. As illustrated, waste is received in a loading zone. The waste may be municipal solid waste. The loading zone may include a sealed trap door to reduce or prevent raw syngas from escaping. The loading zone may be connected to an air purging system to eliminate the accumulation of combustible raw syngas. The waste then enters a waste shredder 430. Waste shredder 430 may be designed to accommodate a threshold or desired volume of waste. In some embodiments, the waste shredder 430 may have up to multiple times the size of each batch of waste, depending pyro-gasifier's capacity. The waste shredder may also receive vitiated air or other type of gasifying agent from a generator to start the drying process at a rotating screw feeder 440. The rotating screw feeder 440 is operated mainly for drying via convective and/or radiation heat transfer. The rotating screw feeder 440 may be calibrated to maintain a desired temperature to facilitate the drying process. For example, the rotating screw feeder 440 temperature may be maintained at a nearly constant 100° C. The rotating screw feeder 440 may also undertake partial devolatilization and gasification. The rotating screw feeder 440 is operated by a motor 490. The rotating screw feeder 440 is hermetically sealed by a labyrinth seal 494. All the labyrinth seals 494 may also include load cells that can measure characteristics of the waste, such as weight and moisture.

The rotating screw feeder 440 is connected to a horizontal allothermally operated hermetic rotary first stage system 410. The rotating screw feeder 440 feeds the shredded waste to the first stage system 410. More specifically, the shredded waste is received by a rotating drum 412 of the first stage system 410. The rotating drum 412 is hermetically sealed by labyrinth seal 494. The rotating drum 412 is operated by a motor 492.

The first stage system 410 enables interaction and/or mixing of solid wastes, gasifying agents, and catalysts. The load cells, which may be located near or alongside the labyrinth seals 494, may measure the weight value of the waste during the pyro-gasification process. When a steady state weight value of the waste is achieved, the first stage system 410 may continue to operate to break down shredded waste into smaller and finer sizes. The shredded waste may be dried wastes and/or char particles at this point. As the breaking down process is occurring throughout the horizontal first stage reactor design 400, a metered amount of a gasifying agent is injected to convert shredded particles into raw syngas. Injection of the gasifying agent may take place in rotating drum 412, or throughout the entire horizontal first stage reactor design 400. The metered amount of the gasifying agent may also be limited to the first stage system 410. Raw syngas may then escape from multiple exit ports. The multiple exit ports may include at least one valve 414. FIG. 4 illustrates three valves 414. The valves 414 may control the amount of syngas entering the second stage of a pyro-gasifier. A control system and data acquisition system my control operation of the valves 414.

Figure 5:
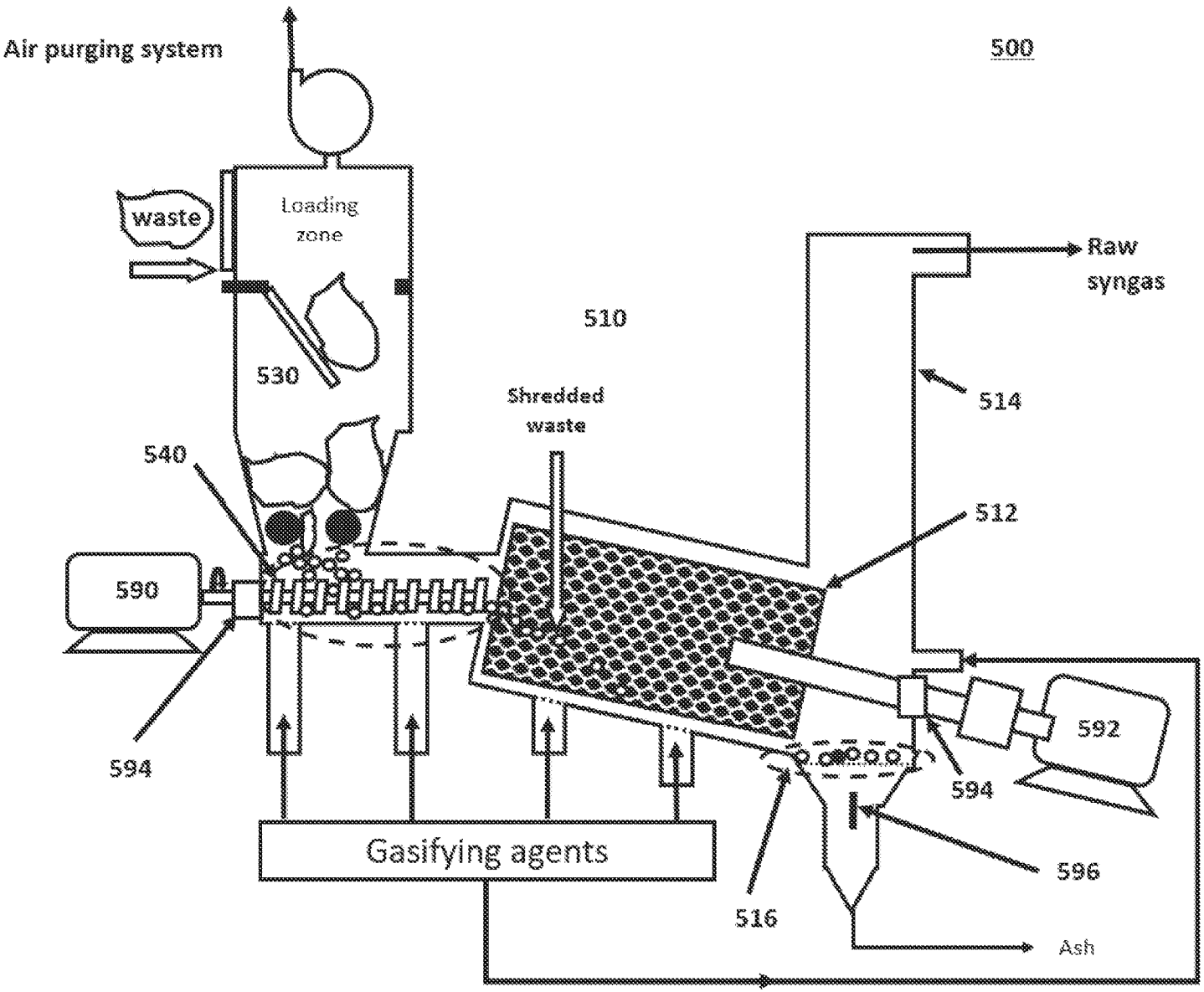
FIG. 5 is an exemplary inclined first stage reactor design of a pyro-gasifier, according to an embodiment of the invention.

FIG. 5 is an exemplary inclined first stage reactor design 500 of a pyro-gasifier, according to an embodiment of the invention. The first stage reactor design 500 is similar to the first stage reactor design 400 in FIG. 4, but features an inclined configuration. First stage reactor design 500 includes a loading zone connected to an air purging system. The waste then enters a waste shredder 530, which then feeds shredded waste to a rotating screw feeder 540. The rotating screw feeder 540 is operated by a motor 590 and is hermetically sealed by a labyrinth seal 594. All the labyrinth seals 594 may also include load cells that can measure characteristics of the waste, such as weight, and moisture.

Unlike the example in FIG. 4, the rotating screw feeder 540 in FIG. 5 is connected to an inclined allothermally operated hermetic rotary first stage system 510. The rotating screw feeder 540 feeds the shredded waste to the first stage system 510. More specifically, the shredded waste is received by an inclined rotating drum 512 of the first stage system 510. The inclined rotating drum 512 is hermetically sealed by labyrinth seal 594. The rotating drum 512 is operated by a motor 592. To accommodate the inclined rotating drum 512, the motor 592 may also be inclined.

The first stage system 510 enables interaction and/or mixing of solid wastes, gasifying agents, and catalysts. The load cells, which may be located near or alongside the labyrinth seals 594, may measure the weight value of the waste during the pyro-gasification process. When a steady state weight value of the waste is achieved, the first stage system 510 may continue to operate to break down shredded waste into smaller and finer sizes. The shredded waste may be char particles at this point. As the breaking down process is occurring throughout the inclined first stage reactor design 500, a metered amount of a gasifying agent is injected to convert shredded particles into raw syngas. Injection of the gasifying agent may take place in rotating drum 512, or throughout the entire inclined first stage reactor design 500. The metered amount of the gasifying agent may also be limited to the first stage system 510. The inclination may permit for gasifying agents to be delivered at a higher entry point. In some embodiments, such as illustrated in FIG. 5, this entry point may be above the labyrinth seal 594. Raw syngas may then escape from through a single exit port 514. In some embodiments, there can be more than one exit port. Also, in some embodiments, exit port 514 may include a valve.

The inclined rotating drum 512 permits metals that are not gasified to be removed and collected with the assistance of gravity in collection area 516. The collected metals may include one, or both, of magnetic and non-magnetic metals. The collection area 516 may be opened periodically to remove collected metals through an ash valve 596. This permits a ferrous and non-ferrous metal separator at the first stage.

The example embodiments being thus described, it will be obvious that the same may be varied in many ways. Such variations are not to be regarded as a departure from the disclosed subject matter, and all such modifications are intended to be included within the scope of the disclosed subject matter.

What is claimed is:

1. A pyro gasifier comprising:

a first stage connected to a source of waste, the first stage comprising:

a waste shredder configured to receive the waste and generate shredded waste, a rotating screw feeder directly and sequentially connected to the waste shredder, wherein the rotating screw feeder is configured to receive the shredded waste, generate dried shredded waste, and transport the dried shredded waste, a rotating drum sequentially connected to the rotating screw and configured to rotate, wherein the rotating drum is configured to receive the dried shredded waste from the rotating screw feeder and generate the fine particulates and the raw syngas, and at least one exit port facilitating transfer of the raw syngas out of the first stage, the raw syngas being a gas that escapes out of the at least one exit port; and a second stage comprising a swirler system, the swirler system comprising:

a recirculating loop with a compressor configured to circulate the raw syngas and output purified syngas; and a rotating screw attached to a mechanical seal configured to prevent the circulating syngas from escaping; and wherein the rotating screw feeder and the rotating drum are both connected to a source of a gasifying agent to facilitate a drying process at the rotating screw feeder and the rotating drum.

2. The pyro gasifier of claim 1, wherein the first stage comprises:

a motor configured to rotate the rotating screw feeder, wherein the rotating screw feeder is hermetically sealed, and wherein a metered amount of the gasifying agent is injected into the rotating drum to convert the dried shredded waste into at least one of the fine particulates and the raw syngas.

3. The pyro gasifier of claim 2, wherein rotating screw feeder is hermetically sealed by a labyrinth seal.

4. The pyro gasifier of claim 1, wherein a metered amount of the gasifying agent is injected into the rotating screw feeder to generate the dried shredded waste and into the rotating drum to convert the fine particulates into the raw syngas.

5. The pyro gasifier of claim 1, wherein the raw syngas includes at least one of: carbon monoxide (CO), char particulates, carbon dioxide ($CO_2$), hydrogen ($H_2$), methane ($CH_4$), and acetylene ($C_2H_2$).

6. The pyro gasifier of claim 1, wherein the at least one exit port comprise at least one valve configured to control an amount of raw syngas entering the second stage.

7. The pyro gasifier of claim 1, wherein the gasifying agent is extracted from the purified syngas as part of an energy conversion process.

8. The pyro gasifier of claim 1, wherein the swirler system is configured to receive the gasifying agent to facilitate the generation of the purified syngas.

9. The pyro gasifier of claim 1, wherein the gasifying agent includes at least one of hydrogen peroxide ($H_2O_2$), oxygen ($O_2$), vitiated air, product of a gas engine, and product of a turbine generator.

* * * * *